US006105685A

United States Patent [19]

Bald

[11] Patent Number: 6,105,685

[45] Date of Patent: Aug. 22, 2000

[54] ADJUSTING DEVICE FOR AN UNBALANCE VIBRATOR WITH ADJUSTABLE CENTRIFUGAL MOMENT

[75] Inventor: Hubert Bald, Bad Berleburg, Germany

[73] Assignee: GEDIB Ingenieurburo und Innovationsberatung GmbH, Bad Berleburg, Germany

[21] Appl. No.: 09/077,232

[22] PCT Filed: Nov. 25, 1996

[86] PCT No.: PCT/EP96/05204

§ 371 Date: Jun. 22, 1998

§ 102(e) Date: Jun. 22, 1998

[87] PCT Pub. No.: WO97/19765

PCT Pub. Date: Jun. 5, 1997

[30] Foreign Application Priority Data

Nov. 26, 1995 [DE] Germany ..... 195 43 910

[51] Int. Cl.[7] ..... B06B 1/18

[52] U.S. Cl. ..... 173/49; 173/2

[58] Field of Search ..... 173/49, 4, 10, 173/1, 2; 175/19, 56

[56] References Cited

U.S. PATENT DOCUMENTS

| | | | |
|---|---|---|---|
| 4,830,597 | 5/1989 | Steier et al. | 173/49 |
| 4,971,158 | 11/1990 | Salmi | 173/1 |
| 5,281,775 | 1/1994 | Gremillion | 173/49 |
| 5,355,964 | 10/1994 | White | 173/1 |
| 5,911,280 | 6/1999 | Bald | 173/49 |

FOREIGN PATENT DOCUMENTS

| | | |
|---|---|---|
| 0467758 | 1/1992 | European Pat. Off. . |
| 4301368 | 1/1994 | Germany . |
| 4407013 | 9/1995 | Germany . |
| 9108842 | 6/1991 | WIPO . |

*Primary Examiner*—Scott A. Smith
*Attorney, Agent, or Firm*—Alix, Yale & Ristas, LLP

[57] ABSTRACT

An adjusting device for an unbalance vibrator with adjustable centrifugal moment. The invention concerns specifically the specialised category of vibrators in which each unbalance shaft has its own motor (110, 112, 114, 116) and no transmission system is provided for connecting the minimum of four unbalance shafts. A novel way of hydraulically actuating the motors is described for ram vibrators of this type provided with four hydraulic motors (110, 112, 114, 116). This involves connecting two motors (the ones allocated to the two unbalance shafts which always rotate synchronously counter to one another even during adjustment) in parallel to their own respective hydraulic circuits. Each of the two hydraulic circuits (118, 120) has its own pump (P1, P2) and the pressures in the forward flow and/or back flow lines can be adjusted independently from the outside by a control and regulation device (126, 128) in such a way that they can be used to set the centifugal moment in a predeternmined manner. A particular advantage lies in the fact that all the motors (110, 112, 114, 116) are subjected to the same load when the centrifugal moment is greatest. In a special embodiment, both pumps (P1, P2) can also be used in open circulation.

20 Claims, 2 Drawing Sheets

Δp
ΔMD
ΔP
mot.
gen.
KA
KB
E
H
K
N
F
D
A
G
B
M
J
C
∢β
0°
90°
180°
270°
360°
=0°
S2
E'
H'
F'
D'
K'
C'
N'
L'
J'
M'
S1
B'
A'
gen.
mot.

ADJUSTING DEVICE FOR AN UNBALANCE VIBRATOR WITH ADJUSTABLE CENTRIFUGAL MOMENT

BACKGROUND OF THE INVENTIONS

1. Field of the Invention

The invention relates to varying the relative setting angle β of vibration generators having at least two pairs of part unbalance elements that can be adjusted in relation to each other.

2. Description of the Prior Art

Adjustable vibration generators are described in published International Application WO91/08842 and in PCT/EP90/02239. In the description of the present invention, for the purpose of simplification, the same terminology is employed as is used in the last-mentioned publication, relating to the part unbalance elements and the partial centrifugal forces (or partial centrifugal force vectors) associated with such elements, as well as relating to a "pair" of part unbalance elements. By comparison with the publications cited above, the relative setting angle β is defined below in such a way that the value β=0° corresponds to an oscillatory amplitude of zero, and the value β=180° corresponds to a maximum oscillatory amplitude.

The relative setting angle β of an adjustable vibration generator is theoretically defined between the partial centrifugal force vectors of the individual part unbalance elements of a "pair" of part unbalance elements. In practice, it is also possible to define the relative setting angle β between features (for example geometric features) of the part unbalance elements of a pair, provided that the position of the mass center of gravity of the eccentric mass of each element is known. The identifier "MR" is commonly used for the reaction moments "MR" which, during each unbalance rotation through the rotation angle $\mu=2\pi$, occur twice as alternating moments at the shafts of the part unbalance elements [these alternating moments have a sinusoidal waveform with two minimum and two maximum values per revolution of the part unbalance element].

The average reaction moments, which act in only one direction and can be calculated by integrating MR over the angle of rotation $\mu=2\pi$ and by subsequent division of the integration value by $2\pi$, are referred to as "MRQ". As will be apparant to those skilled in the art, for example from above-referenced WO91/08842, in the event of a relative setting angle being set to $0°<\beta<180°$, these average reaction moments MRQ act on the part unbalance elements of a pair in such a way that the reaction moments MRQ of one kind try to accelerate the rotation of the part unbalance elements of one kind, and the reaction moments MRQ of the other kind try to retard the rotation of the part unbalance elements of the other kind. In the case of a 4-shaft unbalance vibrator having a motor coupled to each shaft, this mode of operation leads to the situation where, in the case of a vibrator that is operating at idle with a relative setting angle set to be $0°<\beta<180°$, two of the motors have to operate as motors and two of the motors have to operate as generators. Reference is made at this point to the fact that, for the description "unbalance moment", further descriptions, such as "static moment" are also known to those skilled in the art.

FIG. 1 of published German Patent Application 43 01 368 shows a hydraulically operated "gearless vibrator" with an adjustable unbalance moment, with the first motors 103 and 104 that belong to the first part unbalance elements and the second motors 107 and 108 that belong to the second part unbalance elements. The first two motors are supplied in parallel and at the same input pressure by a volume flow that is generated by the adjustable pump 114. The second two motors are each connected to a first motor by means of a series circuit. This is a so-called open circuit for the fluid medium.

The range of adjustment for the unbalance moment in the arrangement of DE A 43 01 368 is limited to an angle $0°\leqq\beta\leqq90°$. The vibrator shown is provided with the capability of maintaining the mirror-image synchronous running of the angle of rotation of part unbalance elements of the same kind, even under the influence of the disruptive forces that are generally to be expected, but at least over that range of adjustment in which the maximum unbalance moment can be set. This capability is viewed as derived from the effects of those alternating moments which are produced by the reaction moments MR and which are also originally responsible for the production of the average reaction moments MRQ. In the DE A 43 01 368, nothing is stated about the behavior of the stability of the mirror-image synchronous running of the part unbalance elements of the same kind in each case during the conceivable use of another kind of control for the angle β for a range of adjustment $90°\leqq\beta\leqq180°$. In the event of a closer inspection of the configuration shown, it is possible to demonstrate that, when operating at the maximum unbalance moment (which is more likely the normal case, given the envisaged range of use of the invention), taking into account the "pressure sum", the first motors are loaded more than two and a half times as much as the second motors. In this case, the "pressure sum" is the sum of input pressure and output pressure at the motor, which is decisive for the service life of the motors.

In the case of the vibrator shown, in addition to the extremely asymmetrical loading of the motors, it has to be viewed as an additional disadvantage that, for the purpose of achieving comparably large resultant unbalance moments, the partial unbalance moments of the part unbalance elements have to be dimensioned to be larger than normal. This leads to unnecessarily increased bearing forces and reaction torques MRQ.

In the case of the vibrators described using FIGS. 1 and 4, DE A 43 01368 methods of influencing the motors for the purpose of setting a predefined relative setting angle β are used with which, in fact, it is not possible to open up a range of adjustment from β=90° to β=180°. As will be shown later, the methods described primarily suffer from the fact that they have not taken into account the influence of the bearing frictional power and of the useful power, which is important in practice.

As noted above, WO91/08842 is of general interest in establishing the state of the prior art. It is particularly noteworthy that the throttling, shown in FIG. 1, of the volume flow passing through the motor 116, said throttling being carried out using the pressure limiting valve 124, cannot lead (starting from a position in which the resultant unbalance moment has the value zero) to changing the relative setting angle β in such a way that the resultant unbalance moment is increased. In order to be able to achieve this effect truly, it would be necessary, with the aid of the function of the element 124, to effect a pressure rise between input and output of the motor 116, while at the same time a reduction in the pressure takes place between the input and output of the motor 114. For the purpose of satisfying the desired function, it would also be necessary in this case to satisfy the condition that the measurable pressure at the input of motor 114 is greater than the measurable pressure at the input of motor 116. This requirement cannot be satisfied on its own (given necessarily equally large volume flows through the two motors), since both the volume flows are taken from a common source (122). FIG. 1 therefore more likely serves in fact to describe the expressions used.

German patent 41 16 647: discloses an adjustable, gearless prior art vibrator with electric motors, each motor being assigned its own electronic regulating device. For each motor, there is a measuring device using which the relative angular position of all the part unbalance elements in relation to one another can be measured continuously. In this case, the angle of rotation of a first part unbalance element is defined as a reference position, and the angles of rotation of the remaining three part unbalance elements are measured as relative angles in relation to the first part unbalance element. In the case of this solution, the individual regulation of the angle of rotation of each part unbalance element means that, in addition to setting the given relative setting angle β, the mirror-image symmetrical rotation angle position between the part unbalance elements of the same kind is also maintained at the same time. This solution is not suitable for use in ram vibrators, and not just because of the enormously high complexity. However, the solution shown gives a good example of the many ways in which loading of the 4 motors of a controllable, gearless vibrator can be carried out.

Published German Application 44 07 013 also makes reference to gearless vibrators. However, the appropriate note on page 6, lines 3 to 8, only reiterates technical details which are already known from DE-A 43 01 368. Reference may also be made to the fact that patent claim 3 does not relate to gearless vibrators. The preamble to this patent claim already rules out any use in gearless vibrators, since the rotors of the adjusting motors are intended to be connected to more than one part unbalance element in each case. In addition, it is possible to derive from the defining part of patent claim 3 (first feature) the fact that the adjusting motors cannot at the same time be drive motors.

A description is given in published German Application 44 25 905 of a technique which can be used, in particular in the case of gearless vibrators in which the resultant unbalance moment can be adjusted, with additional measures to force the synchronous running from a relative angle of rotation which may be defined between the part unbalance elements of the same kind. DE A 44 25 905 also makes reference to the problems of maintaining synchronous running of the relative angle of rotation between the part unbalance elements of the same kind.

SUMMARY OF THE INVENTION

It is the general objective of the present invention to improve the prior art that is described by DE-A 43 01 368 for the use in gearless vibrators which are driven by hydraulic motors or by electric motors and which are adjustable with reference to the resultant unbalance moment. The improvement is intended to achieve 4 aims: at least once the setting has been carried out of the adjustable resultant unbalance moment that is a maximum in the case of the solution found, and while a high useful power is being output (in the case of ram vibrators, via the pile in the ground), it is to be possible for all the four motors to be loaded with the same magnitude, at least when the maximum unbalance moment is set (which is the predominant operation in practice). In addition, when hydraulic motors are being used, it is to be possible to use the pumps to be used both in open and in closed circuit, whilst maintaining this condition. Use of closed circuits may provide advantages, for example in the type of connection that is thereby made possible. In the case of using open circuits, it may be advantageous, for example, to be able to select from a relatively large number of pump types.

Furthermore, the improvement is intended to avoid the over dimensioning of the partial unbalance moments of the part unbalance elements that is necessary in the prior art (avoidance of unnecessarily large bearing forces). This requires the possibility of adjusting relative setting angles even in the range $\beta=90°$ to $\beta=180°$. Finally, the desired solution should also enable the provision of an uncomplicated and rugged vibrator, which is reflected in the invention in the property of acting on each of two motors in parallel.

In relation to ensuring the maintenance of the given relative setting angle β and the relative angle of rotation between the part unbalance elements of the same kind, the requirement of the objective set is as follows: it must be ensured that the necessary relative angle of rotation is kept to reliably, at least for that range of adjustment of the relative setting angle β in which it is possible to set a maximum for the resultant unbalance moment, since a significant working range of the vibrator is seen in this range of adjustment. In the event of asymmetry occurring in the mirror-image synchronous relative angles of rotation (which are present between the part unbalance elements of the same kind), transverse oscillations are produced, and these are not permitted. The improvement as a result of the solution according to the invention is also expected to make it possible to pass continuously through that angular range which lies between the relative setting angle $\beta=0°$ and that relative setting angle $\beta_{max}$ at which the maximum unbalance moment is set.

The present invention is based on the discovery of the considerable disadvantage of the extremely asymmetrical loading of the motors, such as is produced in the prior art (according to DE-A 43 01 368). In practice, this leads to a frequently necessary exchange of motors and/or to a necessary over dimensioning of the motors, and thus also to increasing the outlay. During the evaluation of the diagrams from FIGS. 5 and 6 of DE-A 43 01 368, and from FIG. 1 of DE-A 44 07 013, one receives no reference to the asymmetrical loadings. One good possibility for assessing the loadings of the motors is given by adding (superposing) the reactive powers and active powers which act on the motors. This principle will be described in more detail in conjunction with FIG. 2.

The present invention is specifically directed to unbalance vibrators having a predefined direction of oscillation and being suitable for example, for use as ram vibrators. Such vibrators may have at least four unbalance shafts or part unbalance elements. These elements are rotatably arranged in bearings in the vibrator frame. Each unbalance shaft, or each part unbalance element, has its own motor to which it is coupled without the interposition of a gear mechanism. The motors are used simultaneously as drive motors, for converting the useful power or frictional power (power friction) and bearing friction in the case of a ram vibrator, and as adjusting motors. By means of this type of energy supply for the part unbalance elements, it is also possible to dispense with the geared transmissions that are otherwise employed, i.e., the present invention relates to gearless vibrators with adjustable unbalance moment. The motors which are used within the practice of the invention may be hydraulic motors which are normally able to operate in either a pump or motor mode. Alternatively, electric motors may be employed. The hydraulic motors, when utilized, are driven by a fluid medium, hydraulic oil for example, the flow of the fluid medium having to be produced by one or more pumps which are driven by one or more motors (for example, a diesel engine).

In the practice of the present invention, and in order to achieve the above-stated general objective, it is necessary to observe several operating criteria. These criteria are as follows:

Symmetrical loading of the motors, at least when the maximum unbalance moment is set, and the capability of the vibrator to pass through the angular range from $\beta=0°$ to $\beta=180°$:

With reference to the principle of superposition that is mentioned in the description relating to FIG. 2 of the present invention, the informed reader should himself develop an idea as to the circumstances under which, in the case of a gearless vibrator according to the cited prior art (FIG. 1 in DE-A 43 01 368), the extremely asymmetrical loadings of the motors come about in detail.

The representation of the course of the differential pressures or of the differential torques or of the differential powers according to the diagrams in FIG. 2, using the superposition principle and taking into account its specific kind of configuration of pumps (in the case of a hydraulic solution) and motors, represents a necessary first inventive step in developing the inventive solution. Only in this way is it possible to produce two "tools" or "aids", using which it is possible to assess both the disadvantageous loading of motors in the case of the prior art and the favorable loading of the motors in the case of the inventive solution.

A reminder is given first of the existence of the following principle of action: the mechanical reactive power which has to be introduced into the motor-operated motors and which is passed on to the shafts of the part unbalance elements of one kind (as a power corresponding to the product of reaction moment MRQ times angular frequency $\omega$), is transformed, in a first conversion step, into the "power of the kinetic energy" of the oscillating mass (this mass also being referred to as the "dynamic mass" $m_{dyn}$). In a second conversion step, the "power of the kinetic energy" is once more transformed into a mechanical reactive power, which in turn has to be output by the shafts of the part unbalance elements of the other kind (as a power consisting of reaction moment MRQ times $\omega$). This power is output by the shafts with a first part as the frictional power of the bearings and with a second part as that power which is converted, by the motors that are operated as generators, into a generator power and which has to be output by these motors.

The application of the superposition principle in the graphic representation of the relationships (which will be described in more detail later) clearly explains the mode of operation of the motors that are operated as generators in two different operating ranges: in the operating range which is described in FIG. 2 by the partial curve N'-L'-M', the motors that are operated as generators (114 and 116 in FIG. 1) must be able to output a generator power to the outside. In the operating ranges which are described in FIG. 2 by the two partial curves F'-N' and M'-E'-D', it is necessary for mechanical power to be supplied to the motors that are operated as generators, specifically, in the case of the hydraulic solution, by the volume flow which is led through them, it being necessary in this case for these motors to operate as motors.

Since it must be possible to pass through the whole of the curve KB in the region F'-N'-L'-M'-E'-D' (in the lower diagram in FIG. 2), it is necessary for the motors that are operated as generators to be operated both as generators and as motors in this region. This necessary mode of operation cannot be derived from the teaching of patent claim 3 of DE-A 44 07 013, in which two circuits of motors and pumps are also provided for a different type of vibrator, and in which it is required (in the first feature of the defining part) that a generator reactive power is generated in a motor of one kind while, at the same time, a motor reactive power is generated in a motor of the other kind. In the case of such a mode of operation, it would not be possible to operate, for example, in the operating range M'-E' of the curve KB.

The invention therefore also contains those means which can be used to adjust the relative setting angle $\beta$ from the value $\beta=0°$ to the value $\beta=180°$ continuously. The mode of action of these means can, incidentally, only be explained by reference to the diagrams in FIG. 2.

By contrast with the solution according to German patent 41 16 647, in which each motor is assigned its own measuring device for the angle of rotation of the part unbalance element, and its own regulating device for the angle of rotation, the solution according to the invention, for the purpose of simplicity, makes use of a principle in which only the relative setting angle $\beta$, rather than the angle of rotation $\mu$ of an individual part unbalance element, has to be measured, and in which the two motors of a group are supplied with drive power together and connected in parallel. However, this necessarily presupposes that the mirror-image, symmetrically synchronous relative angle of rotation $\mu$ between part unbalance elements of the same kind (of one group) is maintained by using other means.

Maintaining the mirror-image, synchronous relative angle of rotation between part unbalance elements of the same kind: an additional way of keeping the relative angle of rotation $\mu$ between the part unbalance elements of the same kind in a more stable way has been provided, and is at least effective in the range of relative setting angle $\beta_{max}=180°$, at which the resultant unbalance moment receives the maximum value that can be set. This way, provided for keeping the relative angle of rotation between the part unbalance elements of the same kind stable, is based on the phenomenon that, in the case of an angular value set in accordance with the inventive solution in the angular range $\beta_{max}=180°$, equally large motor torques occur on all the motors. In principle, the operating point $\beta_{max}=180°$ represents an unstable point at which the relative angle of rotation $\mu$ is reduced or increased if a disruptive torque $MD_S$ appears and influences the synchronous relative angle of rotation $\mu$, and if in this case there is no suitable device for regulating the relative angle of rotation.

This property of weakness, which is present in comparison with the situation in the range of an angular value $\beta=0°$, is generally reduced, according to the invention, by the following fact: at the relative setting angle $\beta=180°$, two equally large torques are in equilibrium: the driving torque $MD_A$, which is developed by the motors, and the braking torque $MD_B$, which is produced by the output of active power. The effect of the disruptive torque $MD_S$ is proportional to the ratio $MD_S/MD_A$, or to the ratio $MD_S/MD_B$. It follows from this that the tendency to weakness is reduced in particular during the additional output of useful power (in addition to the bearing frictional power). An additional advantage is that (as can be shown), in the case of the motors that are operated as generators, a self-regulating effect sets in, with a trend toward self-regulation to the value $\beta=180°$ (see also the course of the curves in the vicinity of the points E and E' in FIG. 2). Because of the energetic coupling of the movements of the part unbalance elements of the one and of the other kind, the self-regulating effect thus also has an influence on the synchronous relative angle of rotation of the motors that are operated as motors. A precondition for this mode of operation is that the relative setting angle β must be the subject of control or regulation, which is prescribed in accordance with the teaching of the invention.

A considerable part in maintaining the mirror-image symmetrical synchronous angle of rotation $\mu$ is also played by the alternating moments MR=f($\mu$). The statement which is made in DE-A 43 01 368, in column 6, lines 36 ff., according to which, for the purpose of avoiding other types of synchronization means which (as a result of the co-oscillating dynamic mass) could in principle make use of the automatically acting internal forces only in the range of a relative setting angle β less than 90°, has to be corrected as follows: the effect of the alternating moments MR=f($\mu$), in order to support the maintenance of the synchronism of the mirror-image symmetrically running rotational position of the part unbalance elements of the same kind, not only does not decrease when the relative setting angle β=90° is exceeded in the direction β=180°, but, on the contrary, increases. This can also be explained as follows, using the diagrams of FIG. 5 of DE-A 43 01 368:

Whereas the alternating moments MR=f($\mu$) act predominantly only in one direction of rotation in the range β<90° (using which a deviation of a part unbalance element from the synchronous position $\mu$ can be corrected only in one direction), as the value of the angle β increasingly changes toward the value β=180°, the mode of operation of the alternating moments MR=f($\mu$) changes in such a way that their positive and negative angular momentum components become equally large [the course of the curve MR=f(β=180°) is symmetrical to the axis $\mu$]. Hence, for the alternating moments MR=f($\mu$) in the range β=180°, the result, which is also of benefit within the context of the present invention, is a particularly beneficial effect on the angular synchronism of running, such that both angular deviations $+\Delta\mu$ and angular deviations $-\Delta\mu$ from the desired angular position $\mu_{des}$ can be compensated by the alternating moments MR=f($\mu$).

Suitability for open and closed circuits: in comparison with the vibrator according to the prior art, in the case of the hydraulic solution, given the configuration of pumps and motors according to the invention, it is optionally possible for an open or a closed circuit to be realized. In the case of deciding on an open circuit, it is merely necessary for the following to be observed in the case of the circuit in which the motors can be operated as generators: it is additionally necessary for the following to be installed in the pipeline between the motor output and the pump input: either a controllable throttle for changing the throttling effect, or another power conversion member, in which the hydraulic power is converted into another power as the pressure in the volume flow is reduced.

For the case in which the angular range β=0° to β=180° is to be passed through, and in which a controllable throttle is used for controlling the angle in the case of an open circuit, the power is converted into heat and hence destroyed. The heat power converted is proportional to the differential pressure upstream and downstream of the throttle. However, this is not a particular disadvantage in the case of the ram vibrators which are envisaged to use the invention. In such a case, the adjustability of the centrifugal moment is in most cases only used as follows in the case of these vibrators:

During the adjustment from the rotation frequency zero to the operating rotation frequency, the vibrator is driven using an unbalance moment having the value zero. This method avoids the excitation of resonant frequencies in the ground which lie below the operating frequency. An adjustment of the unbalance moment from the zero value to the maximum value (and vice versa) is carried out only when the rotation frequency has been set to an operating frequency.

BRIEF DESCRIPTION OF THE DRAWING

The present invention may be better understood, and its numerous subjects and advantages will become apparent to those skilled in the art, by reference to the accompanying drawing wherein.

DESCRIPTION OF THE DISCLOSED EMBODIMENT

Figure 1:
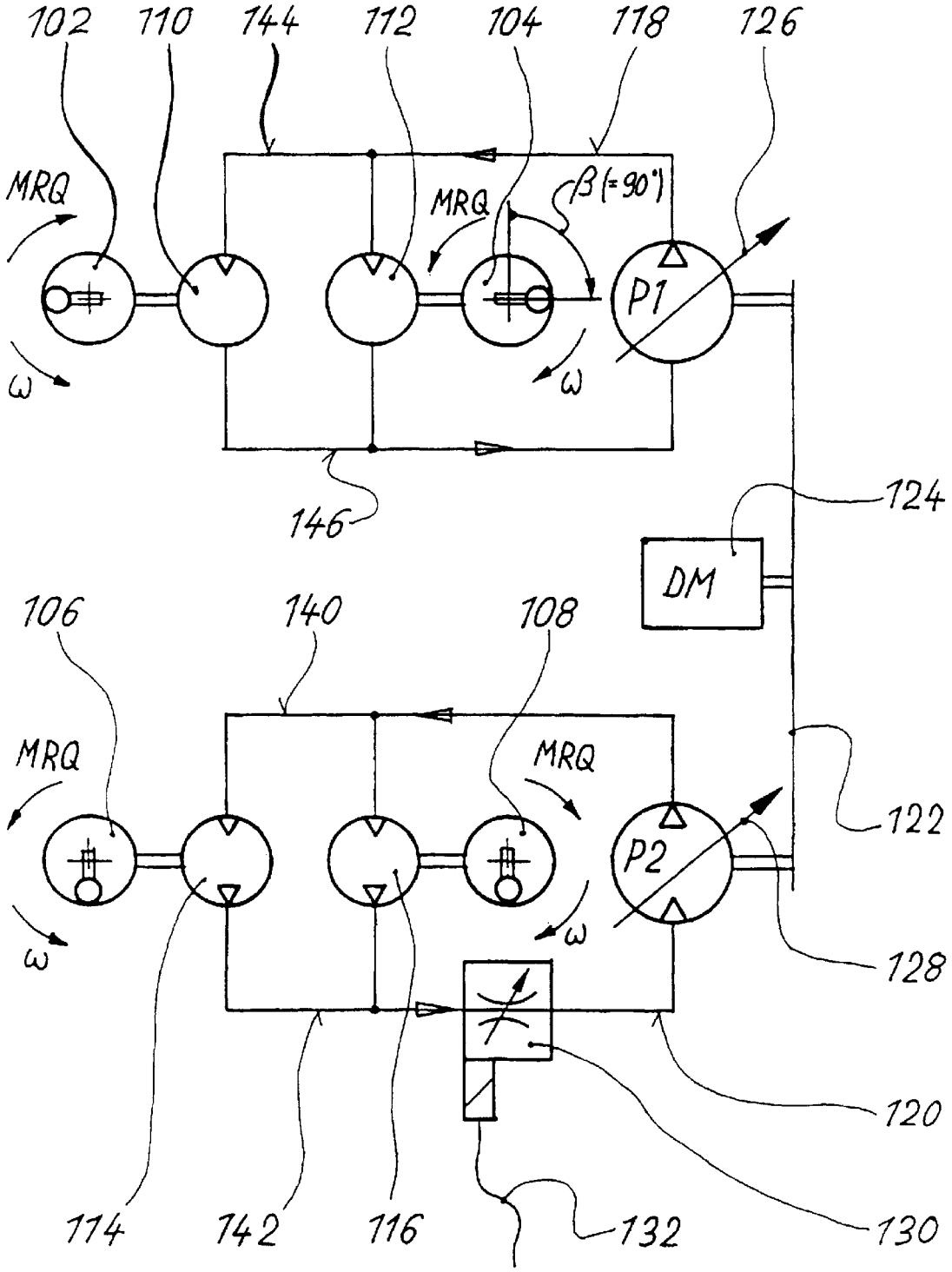
FIG. 1 is a schematic illustration of an adjusting device for a gearless vibrator with adjustable unbalance moment in accordance with the invention.

FIG. 1 shows (with a symbolic representation of the four part unbalance elements by four corresponding circles) two part unbalance elements of the one kind 102, 104 and two part unbalance elements of the other kind 106, 108, which can rotate (in a manner not shown) about their common axles 160, the latter being mounted in bearings 162 in the vibrator frame 164. Each part unbalance element is connected to its own hydraulic motor (M), by which it can be driven or braked for the purpose of adjusting the relative setting angle β, and by means of which it is possible to supply to the part unbalance element that power which is partly subsequently lost in the form of bearing frictional power and which partly flows into the ground in the form of useful power, output to the pile, for example, after this part of the power has previously been transmitted by means of the bearing forces to the oscillating dynamic mass $m_{dyn}$.

The adjusting device for the relative setting angle β which is illustrated in FIG. 1 is defined for operation in the range β=0° to β=180°, which is intended to be indicated by the arrows shown, which symbolize effects and directions. The part unbalance elements of the one kind 102, 104 are respectively coupled to motors 110, 112 of the one kind, and the part unbalance elements of the other kind 106, 108 are respectively coupled to motors 114, 116 of the other kind. The respective direction of rotation of the motors and of the part unbalance elements is shown by arrows with the symbol ω. The motors of a same kind are in each case connected in parallel fashion to a closed hydraulic circuit of the one kind 118 or of the other kind 120, whose volume flow is generated by a respectively associated pump P1 of the one kind or pump P2 of the other kind.

The (positive) relative setting angle β=90° shown is derived from a basic position β=0°, at which the overall resultant unbalance moment has the value zero.

By contrast with the hydraulic circuit of the one kind, the motors and the pump P2 of the hydraulic circuit of the other kind are able to generate pressure differences in both directions. This means that the motors are able to operate both as motors and as pumps (generators) and that the pump P2 is able to operate both as a pump (generator) and as a motor.

Both pumps are connected to a common diesel engine DM via a drive device 122. The drive device could be a common shaft or a distributor geared transmission. As symbolized by the arrows 126 and 128, both pumps are equipped with adjusting devices for adjusting the delivery volume, so that these pump adjusting devices, if they are changed synchronously, are able to be used to change the volume flows and hence the rotational frequencies of the motors within predefined limits.

Incorporated into the hydraulic circuit of the other kind is a component 130, through which the volume flow of the return line 120 flows and which is able to throttle the volume flow in a predefined manner and, in so doing, to generate a predefinable pressure in the feed line upstream of its input. The level of the pressure built up in this way may be predefined by means of an electric control device, which influences the constructional element 130 via an electric line 132.

For the case in which the motors 114, 116 are supplied with a vibrator reactive power, in such a way that said motors can or must operate as generators, a pressure is then produced, upstream of the component 130, which has a direct relationship with the relative setting angle β that is simultaneously set as a result of the effect of the pressure. Provided the product of the pressure generated and the volume flow does not exceed the maximum vibrator reactive power, it is possible to influence the reactive power generated by the motors 114, 116 of the other kind directly, as desired, by influencing the throttling pressure, and hence also, indirectly, to influence the relative setting angle β.

Drawn by the circular symbols for the part unbalance elements are arrows, which are assigned the symbols MRQ. The directions of the arrows indicate the direction of action of the average reaction moments MRQ. It can be seen that, in the case of the part unbalance elements of the one kind 102, 104, the direction of action of MRQ is opposed to the direction of rotation (symbolized by ω). This means that, for the purpose of maintaining the angular frequency ω and the set relative setting angle β, the motors of the one kind 110, 112 must apply an opposing torque of the motor kind, with a value which is as large as the value of MRQ, and without any useful power accordingly being output by the vibrator.

In the case of the part unbalance elements of the other kind 106, 108, the reaction moments MRQ act in the direction of rotation. In this case, if the motors of the other kind 114, 116 were not to produce a braking torque of the same magnitude as the magnitude of the reaction moments MRQ produced, but in the opposite direction to MRQ, or if in this case the motors of the other kind were not to convert a torque of a generator kind that was introduced from the outside into hydraulic power, this would result in an acceleration of the angular frequency ω, or this would produce an increase in the relative setting angle β (which has the value β=90° in the example shown).

The configuration according to FIG. 1 does not show all the components which otherwise belong to the complete adjusting device and which those skilled in the art can additionally imagine. In this connection, mention is made only of the fact that the cooperation of a control or regulating device is assumed, this being used to make it possible to set a predefined relative setting angle β. If a regulating device is to be provided, it is not absolutely necessary for the relative setting angle β to be the controlled variable. In principle, such a solution in which the relative setting angle is influenced only indirectly will be sufficient, but this angle must be a known function of the actual controlled variable. If the relative setting angle β is itself intended to be the direct controlled variable when using a regulating device, it is necessary to provide a measuring device with which the relative setting angle β can be measured. In this case, this may be a measuring device such as is shown, for example, in DE-A 44 07 013 in conjunction with FIG. 2 shown there.

Figure 2:
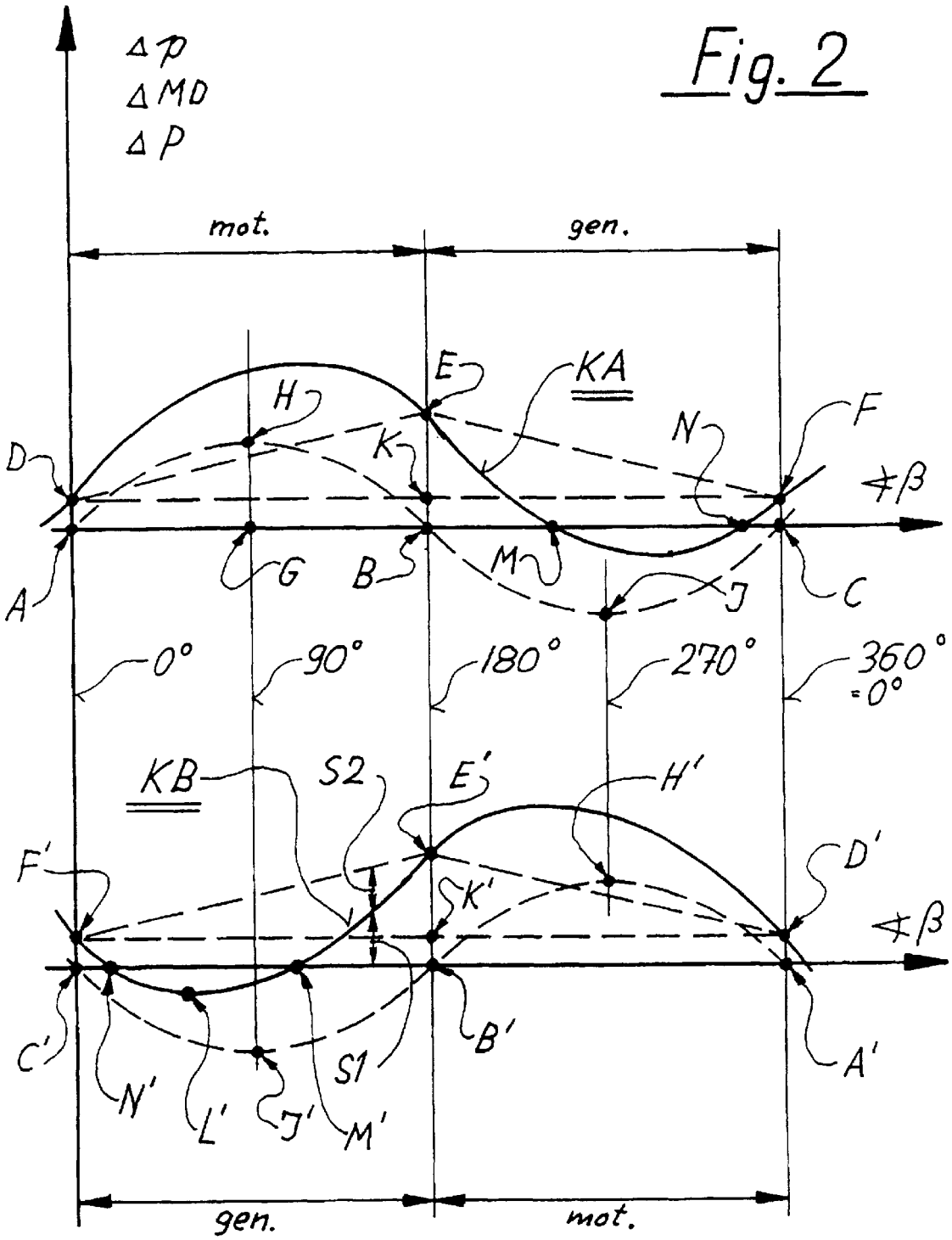
FIG. 2 is a graphical representation of the operation of the control of FIG. 1.

Shown in FIG. 2 are two diagrams, of which the upper diagram describes, by way of the characteristic curve KA, specific states on the motors 110, 112 of the one kind, and the lower diagram describes, by way of the characteristic curve KB, specific states on the motors 114, 116 of the other kind. Plotted on the abscissa axis of the two diagrams is the relative setting angle β, whereas the values of the ordinate axis may be indicated as different variables, although these may be derived from one another. The different variables provided are: the differential pressure Δp across the motors, the differential torque ΔMD (proportional to Δp) across the motors and the differential power ΔP (proportional to Δp) of the motors.

The range shown for the angle β is 360°. It can be seen that at β=0°, β=360° and at β=180°, respectively, there is a change between motor operation (abbreviated "mot."), and generator operation (abbreviated "gen."). The motor and the generator regions are identified by double arrows bearing the designations "mot." and "gen.". The characteristic curves KA and KB are given from the superposition or addition of different variables which will be explained in more detail using the example of the diagram variable "differential torque ΔMD". The characteristic curves KA and KB in this case represent the torques which act on the motors.

In the upper diagram, the broken line D-E-F reproduces the course of the torque by means of which the overall frictional power is generated. The overall frictional work comprises two components: one component is indicated by the broken line D-K-F and represents the frictional moment of the bearing friction, with a magnitude corresponding to the distance A-D. The bearing friction has a constant magnitude over the entire angular range. The other component, which has the value zero at the point D and at the point F, and has its maximum value (corresponding to the distance K-E) at the point E (at β=180°), represents the course of the useful work torque which is needed for the useful work (it predominantly equals frictional work of the pile). The linearly drawn course of the useful work torque is a simplification of the useful work torque which, in practice, is nonlinear. The simplification shown is based on the assumption that the useful work torque is produced approximately proportionally to the magnitude of the amplitude of the oscillation, which, as is known, likewise changes with the magnitude of the angle β.

The magnitude of the reaction moment MRQ, which depends on the angle β, runs in accordance with the broken line A-H-B-J-C. The reaction moment MRQ has a sinusoidal waveform with the amplitude corresponding to the distance G-H at β=90°. By superimposing the values of the characteristic curve for the reaction moments MRQ and the values of the characteristic curve for the torques for the overall frictional work, the final result is the characteristic curve KA. The phenomenon that the reaction moment MRQ has the value zero at β=0° (and, respectively at β=360°) and at β=180°, means that the values of the characteristic curve KA represent only friction work torques at the points β=0° (=360°) and β=180°.

Since the maximum values for the friction work torques (corresponding to the distance B-E) and for the reaction moments MRQ (corresponding to the distance G-H) are shown approximately to the correct scale for those operations which are carried out using real ram vibrators at high rotational frequencies of the part unbalance elements, the result in practice is, for the range β=90° to β=180°, a special angular range from the point M as far as the point N, over which range torques ΔMD acting in the generator sense are also needed on the motors of the one kind.

The characteristic curve KA is drawn for the operation of a ram vibrator having a high loading as a result of the useful work which is transmitted from the pile into the ground. In the case of a low proportion of useful work, the point E migrates downward in the direction of the point K. When the ram vibrator is idling (without any contact between pile and ground) and the useful work is equal to zero, the point E coincides with the point K. Mention is again made of the fact that the magnitude of the maximum value of the reaction moment MRQ (distance G-H) varies both with the magnitude of the dynamic mass, which also includes the mass of the pile, and with the depth of the penetration of the pile into the ground, or with the magnitude of the useful work output.

The course of the characteristic curve KB in the lower diagram results from superimposing all the moment curves similarly as in the characteristic curve KA, but with the difference that, in the range $\beta=0°$ to $\beta=180°$, the reaction moment MRQ can have a negative course, whereas the friction work torques only appear in positive form here, too. If a comparison is made between the two characteristic curves KA and KB, it is noteworthy that, at the angle $\beta=180°$, the torques $\Delta MD$, which load the motors of the one and of the other kind, have the same magnitude and are positive in both cases, which means that the motors are subjected only to motor loading.

The point which is of particular interest for the present invention in the case of using the vibrator as a ram vibrator is the operation of the gearless ram vibrator in the mode of operation according to FIG. 1 over the entire range of the angle $\beta$ from $\beta=0°$ to $\beta=180°$. Before the actual ramming work begins, the vibrator is firstly run up, with the relative setting angle $\beta=0°$ set, to an operating frequency which lies above the ground resonant frequency. Only then is the angle $\beta$ predefined for the ramming work set (in most cases to the value $\beta=180°$) with the aid of the adjusting device. In the event of keeping the relative setting angle $\beta$ constant, or changing it, it is necessary for the differential torques according to the characteristic curve KA to be set on the motors of the one kind, and at the same time for the differential torques according to the characteristic curve KB to be set on the motors of the other kind.

It is an interesting effect, which is also utilized within the context of the invention, that, for the purpose of keeping a predefined angle $\beta$ constant or for the purpose of changing the angle $\beta$ in a predefined way, it is sufficient for the required differential torque $\Delta MD$ (or the required differential pressure $\Delta p$) to be set only in the case of the motors of one kind. It is in the nature of the adjusting device selected that, in this case, the necessary relationships between the differential torques $\Delta MD$ (or of the differential pressure $\Delta p$) are established automatically and inherently in accordance with the respective other characteristic curve in the case of the motors of the other kind.

When passing through the angular range $\beta=0°$ to $\beta=180°$, in the case of a mode of operation which corresponds to the characteristic curves KA and KB, it is possible to see the following behavior in relation to the motors of the other kind (114, 116) in accordance with the characteristic curve KB: at the beginning of the adjustment, at $\beta=0°$, the motors are operated as motors with a differential torque $\Delta MD$ corresponding to the distance C'-F'. By reducing the differential torque down to the value zero, it is initially possible to get as far as the point N' on the characteristic curve KB. From this point, in the event of a further increase in the angle $\beta$, it is necessary for a generator differential torque to be produced, until the point M' is reached. After that, given a further increase in the angle $\beta$, it is necessary for a motor differential torque $\Delta MD$ to be produced once more in the motors of the other kind and in a rising manner.

In principle, the action of the generator reaction moment MRQ on the part unbalance elements of the other kind is always present over the entire range of the angle $\beta$ from $\beta=0°$ to $\beta=180°$ (in accordance with the characteristic curve C'-J'-B'). It has been shown that this reaction moment, which always acts like a generator, is automatically used to overcome the friction work torque. The derivation of the friction work torque from the generator reaction moment may take place from the angle $\beta=0°$ up to that angle which is associated with the point M'. In the event of a further increase in the angle $\beta$, the motors of the other kind additionally have to produce a motor torque.

Thus, for example, in the angular range between the points M' and B', where the magnitude of the overall friction work torque has the value S1+S2, the torque component S2 is derived from the reaction moments, whereas the torque component S1 is derived from the motor torques of the motors of the other kind.

When passing through the angular range $\beta=0°$ to $\beta=180°$, using an adjusting device according to the teaching of the patent claim, it is sufficient, when starting from the value $\beta=0°$, to reduce the delivery volume of the pump P2 by a small amount. For the characteristic curve KB, it is then true, for example, for the range from the point F' to L', that (with the cooperation of the leakage bypass volume flow in the motors and in the pump) the pressure in the pipeline 140 is initially reduced until the point N' is reached (down as far as the system filling pressure), and that the pressure in the pipeline 142 is continuously increased from the point N' to the point L' (beginning with the system filling pressure at the point N'). Because of the given coupling between the pumps P1 and P2, via the common drive device 122, the reduction in the delivery volume of the pump P2 has the same effect as if the delivery volume of the pump P1 had been increased. It is only for this reason that the pressure in the pipeline 144 increases. It is obvious that the process also functions conversely: an increase in the delivery volume of pump P2, with the same effect as a reduction in the delivery volume of pump P1, has the effect of reducing the angle $\beta$ in the angular range $\beta=0°$ to $\beta=180°$.

It can be seen that, in the event of using a control or regulating device, the control of the angle $\beta$ to a predefined value can be performed by means of changing the delivery volume on one pump in two directions. It is of course possible for the same effect also to be achieved if the delivery volumes on the two pumps are simultaneously changed in different directions.

When passing through the angular range $\beta=0°$ to $\beta=180°$, and in the event of using an adjusting device according to patent claim 2, in the event of starting from the value $\beta=0°$, it is initially sufficient to reduce the original differential torque $\Delta MD$, acting like a motor, according to the distance C'-F', by increasing the throttling resistance with the aid of the adjustable throttling member 130 and as a result of the increase in the pressure in the pipeline 142 (as a result of this measure), and after this, after arriving at the value zero at the point N', to produce a negative differential torque by means of a further increase in the throttling effect. In order to achieve a further increase in the angle $\beta$ after arriving at the angle $\beta_L$ (which is assigned to the point L'), it is necessary to reduce again the pressure produced in the pipeline 142 by the throttling effect.

Influencing the relative setting angle $\beta$ as described above with the aid of the production of a pressure at the output of the motors of the other kind, by using a throttling member in the return line to the pump P2, may advantageously be supported or changed by means of influencing measures that are taken in parallel or alternatively. These measures include, for example, removing a small bypass volume flow from the main volume flow which leaves the pump P2 at its output, or increasing the delivery volume of the pump P1 by adjusting the pump P1 or by adding a small bypass volume flow to the main volume flow which leaves the pump P1 at the outlet.

In the event of using a throttling member in a return line (for example 142) to a pump for the purpose of producing a generator mode of operation of the appropriately associated motors, no pressures are produced by the return volume flow, either at the input to the pump of the one kind or at the input to the pump of the other kind. For this reason, it is always possible to operate the hydraulic circuits as open circuits as well.

Starting from the relative setting angle $\beta=0°=360°$ at point C (in the upper diagram), it is also possible to reach the relative setting angle $\beta=180°$ by passing through the region of the relative setting angle $\beta$ in the negative direction, specifically from $\beta=360°$ via $\beta=270°$ to $\beta=180°$. As can be seen from FIG. 2, in this case the mode of operation of the motors of the one and of the other kind is exchanged. In the case of such a procedure, it is then necessary to insert the throttling member 130 into the return volume flow of the pipeline 146 of the pump P1.

The technical teaching of the independent claims 1 and 2 is directed toward the exemplary embodiment according to FIG. 1, which in principle represents a (particularly important) development of the main idea of the invention that is disclosed by the description relating to FIG. 2. The independent claims 3 and 4 describe the technical teaching from the main idea presented in FIG. 2 in the event of its being used in conjunction with hydraulic or electric motors. Claims 3 and 4 do not require any specifically explanatory description. For the practical implementation of a vibrator that is operated using electric motors, it is also possible to use the arrangement according to FIG. 1 as an aid, if the following modifications are imagined to be given in FIG. 1:

The motors 110, 112 and 114, 116 constitute electric motors, and the lines 144, 146 and 140, 142 constitute the electric feed lines to the motors. Component 130 is omitted. The symbols for the pumps P1 and P2 each constitute an electrical driver with which the motors can be forced to variable speeds and to develop variable torques, including those of different directions. In this case, it is also possible for a negative torque to be developed at least on the motors 114, 116, while at the same time a positive torque is used on the motors 110, 112.

What is claimed is:

1. An adjusting device for an unbalance vibrator having a vibrating mass, the device comprising:

at least a first pair of part unbalance elements of a first kind (102, 106) and a second pair of part unbalance elements of a second kind (104, 108), each of the unbalance elements being driveable to rotate about an associated axis, each of the unbalance elements having:

a partial centrifugal force vector, the sum of the partial centrifugal force vectors defining a resultant centrifugal force vector whose effect causes the mass of the vibrator to execute directional oscillations, and a partial unbalance moment vector, the sum of all the partial unbalance moment vectors defining a resultant unbalance moment, the resultant unbalance moment vector being proportional to the resultant centrifugal force vector, the partial centrifugal force vectors of the unbalance elements of the first kind defining a setting angle $\beta$ relative to the partial centrifugal force vectors of the unbalance elements of the second kind, wherein the relative setting angle $\beta$ may be set within a range from about $\beta=0°$ to about $\beta=\pm180°$ for the maximum setable resultant unbalance moment, it being possible to pass through the range of adjustment of the relative setting angle $\beta$, at least during the operation of the vibrator, without outputting useful power;

a first hydraulic operating circuit including a pump (P1) and a pair of motors (110, 112) connected in parallel and a second hydraulic operating circuit including a pump (P2) and a pair of motors (114, 116) connected in parallel, a rotor of each motor of the first and second hydraulic operating circuits being coupled to a respective part unbalance element of the first and second kind, respectively, in such a way that a torque can be transmitted therebetween;

at least one drive motor (DM) coupled to the pumps of the first and second hydraulic operating circuit by a connection (122) via which connection drive power can be supplied to the pump or taken from it;

control means for directly or indirectly setting the relative setting angle $\beta$ by setting a predefinable value for the relative setting angle $\beta$, setting a predefinable value for the amplitude of the oscillatory travel x, or setting a predefinable value for the amplitude of a time derivative x' or x" thereof, the predefinable value falling within a range of a minimum resultant centrifugal force vector to a maximum resultant centrifugal force vector; and means for measuring the current value of a controlled variable as the magnitude of the relative setting angle $\beta$ is influenced directly or indirectly;

wherein, the motors of the first hydraulic operating circuit are operated purely as motors and the motors of the second hydraulic operating circuit are alternately operated as generators and motors, hydraulic power generated when the motors of the second hydraulic operating circuit are operated as generators being essentially converted into a corresponding motor power that is output by the pump (P2) of the second hydraulic operating circuit.

2. The adjusting device as claimed in claim 1, wherein the second hydraulic circuit further includes a special power conversion member (130) and the motors (114, 116) impress a hydraulic power on a volume flow which is converted into a different power by the special power conversion member (130) and the pump (P2) in the second hydraulic circuit, which outputs the power that it has converted in the form of motor power.

3. The adjusting device as claimed in claim 2, wherein the power conversion member (130) is a throttle that can be influenced in relation to the level of its throttling effect.

4. The adjusting device as claimed in claim 1, wherein power generated in the motors which are operated as generators is fed back to the motors which are operated as motors:

by connecting the motors which are operated as generators and as motors in series, or by mechanically coupling two pumps in the two different hydraulic circuits, or by transmitting electrical energy from the motors operated as generators to the motors operated as motors.

5. The adjusting device as claimed in claim 1, wherein when the relative setting angle is set to be $\beta=180°$, the maximum resultant centrifugal force vector is set and wherein, at the same time, the useful power output to the outside by the vibrator in the motors of the unbalance elements of the first kind is essentially the same power as is converted in a motor fashion in the motors of the unbalance elements of the second kind.

6. The adjusting device as claimed in claim 1, wherein at least one of the hydraulic circuits is constructed as a closed circuit.

7. The adjusting device as claimed in claim 1, wherein the magnitude of the delivery volume of the two pumps is adjustable and wherein the two pumps are adjusted differently in order that the pressure relationships that are necessary to set or adjust a predefined value for the relative setting angle β (or for a variable that is functionally linked thereto) are provided in at least one of the hydraulic circuits.

8. The adjusting device as claimed in claim 1, wherein the pressure relationships that are necessary to set or adjust a predefined value for the relative setting angle β (or for a variable that is functionally linked thereto) are effected in at least one hydraulic circuit by supplying an additional volume flow to the main volume flow or by removing a specific volume flow from the main volume flow.

9. The adjusting device as claimed in claim 1, wherein each part unbalance element is coupled to a further adjusting drive motor.

10. The adjusting device as claimed in claim 1, wherein the motors are at the same time adjusting motors and drive motors.

11. The adjusting device as claimed in claim 1, wherein each of the hydraulic circuits further includes at least two hoses providing fluid communication between the pump and the motors.

12. The adjusting device as claimed in claim 1, wherein the unbalance vibrator is provided as a ram vibrator.

13. An adjusting device for an unbalance vibrator having a vibrating mass, the device comprising:

at least a first pair of part unbalance elements of a first kind (102, 106) and a second pair of part unbalance elements of a second kind (104, 108), each of the unbalance elements being driveable to rotate about an associated axis, each of the unbalance elements having:

a partial centrifugal force vector, the sum of the partial centrifugal force vectors defining a resultant centrifugal force vector whose effect causes the mass of the vibrator to execute directional oscillations, and a partial unbalance moment vector, the sum of all the partial unbalance moment vectors defining a resultant unbalance moment, the resultant unbalance moment vector being proportional to the resultant centrifugal force vector, the partial centrifugal force vectors of the unbalance elements of the first kind defining a setting angle β relative to the partial centrifugal force vectors of the unbalance elements of the second kind, wherein the relative setting angle β may be set within a range from β>90° to about β=±180° for the maximum setable resultant unbalance moment, it being possible to pass through the range of adjustment of the relative setting angle β, at least during the operation of the vibrator, without outputting useful power;

a first hydraulic operating circuit including a pump (P1) and a pair of hydraulically operating motors (110, 112) connected in a parallel fashion and a second hydraulic operating circuit including a pump (P2) and a pair of hydraulically operating motors (114, 116) connected in a parallel fashion, a rotor of each motor of the first and second hydraulic operating circuits being coupled to a respective part unbalance element of the first and second kind, respectively, in such a way that a torque can be transmitted therebetween;

at least one drive motor (DM) coupled to the pumps of the first and second hydraulic operating circuit by a connection (122) via which connection drive power can be supplied to the pump or taken from it;

control means for directly or indirectly setting the relative setting angle β by setting a predefinable value for the relative setting angle β, setting a predefinable value for the amplitude of the oscillatory travel x, or setting a predefinable value for the amplitude of a time derivative x' or x" thereof, the predefinable value falling within a range of a minimum resultant centrifugal force vector to a maximum resultant centrifugal force vector; and means for measuring the current value of a controlled variable as the magnitude of the relative setting angle β is influenced directly or indirectly;

wherein, the motors of the first hydraulic operating circuit are operated purely as motors and the motors of the second hydraulic operating circuit are alternately operated as generators and motors, hydraulic power generated when the motors of the second hydraulic operating circuit are operated as generators being essentially converted by the action of a special element for power conversion (130) into another kind of power that is not fed to the pump (P1) of the first hydraulic operating circuit.

14. The adjusting device as claimed in claim 13, wherein the power conversion member (130) is a throttle that can be influenced in relation to the level of its throttling effect.

15. The adjusting device as claimed in claim 13, wherein no two motors are connected in a series circuit.

16. The adjusting device as claimed in claim 13, wherein the second hydraulic circuit further includes a special power conversion member (130) and the motors (114, 116) impress a hydraulic power on a volume flow which is converted into a different power by the special power conversion member (130) and the pump (P2) in the second hydraulic circuit, which outputs the power that it has converted in the form of motor power.

17. The adjusting device as claimed in claim 13, wherein each of the hydraulic circuits further includes at least two hoses providing fluid communication between the pump and the motors.

18. The adjusting device as claimed in claim 13, wherein no two motors are connected in a series circuit.

19. An adjusting device for an unbalance vibrator having a vibrating mass, the device comprising:

at least two groups of part unbalance elements, each of the groups including two part unbalance elements, each of the unbalance elements being driveable to rotate about an associated axis, the part unbalance elements of the first group rotating synchronously in a first direction and the part unbalance elements of the second group rotating synchronously in a direction opposite to the first direction with mirror-image symmetrical angles of rotation, each of the unbalance elements having a centrifugal force, the sum of the centrifugal forces causing the mass of the vibrator to execute directional oscillations, the part unbalance elements of the second group defining a setting angle β relative to the part unbalance elements of the second group;

a hydraulic motor coupled to each of the part unbalance elements in such a way that a torque can be transmitted therebetween, the setting angle β being adjustable by the hydraulic motors, each of the motors having an input and an output;

hydraulic drive and control means for generating a volume flow through the motors and for generating hydraulic pressures, at least at the inputs to the hydraulic motors;

control means for directly or indirectly setting the relative setting angle β by setting a predefinable value for the relative setting angle β, setting a predefinable value for the amplitude of the oscillatory travel x, or setting a predefinable value for the amplitude of a time derivative x' or x" thereof, the predefinable value falling within a range of a minimum resultant centrifugal force vector to a maximum resultant centrifugal force vector; and means for measuring the current value of a controlled variable as the magnitude of the relative setting angle β is influenced directly or indirectly;

wherein:

measurable pressure gradients of different signs are setable by the control means between the inputs and outputs of the motors of the first group of part unbalance elements and the inputs and outputs of the motors of the second group of part unbalance elements, the pressure gradient of the motors of one of the groups alternating from a positive value to a negative value, while passing through a range of adjustment from a smaller resultant static moment to a maximum resultant static moment, the motors being in a generate mode of operation when the pressure gradient has a positive value, the values of the pressure gradients on the hydraulic motors of one group are equal in terms of direction and average magnitude, while maintaining the preferred direction of oscillation of the vibrator, and the predefinable value is set by influencing the values of the pressure gradients on the hydraulic motors, in terms of magnitude and direction, with the aid of the control means.

20. An adjusting device for an unbalance vibrator having a vibrating mass, the device comprising:

at least two groups of part unbalance elements, each of the groups including two part unbalance elements, each of the unbalance elements being driveable to rotate about an associated axis, the part unbalance elements of the first group rotating synchronously in a first direction and the part unbalance elements of the second group rotating synchronously in a direction opposite to the first direction with mirror-image symmetrical angles of rotation, each of the unbalance elements having a centrifugal force, the sum of the centrifugal forces causing the mass of the vibrator to execute directional oscillations, the part unbalance elements of the second group defining a setting angle β relative to the part unbalance elements of the second group;

an electric motor coupled to each of the part unbalance elements in such a way that a torque can be transmitted therebetween, the setting angle β being adjustable by the electric motors, the motors of the unbalance elements of each group being electrically connected in parallel and acted upon together;

electric drive and control means for generating an electrical current through the motors;

control means for directly or indirectly setting the relative setting angle β by setting a predefinable value for the relative setting angle β, setting a predefinable value for the amplitude of the oscillatory travel x, or setting a predefinable value for the amplitude of a time derivative x' or x" thereof, the predefinable value falling within a range of a minimum resultant centrifugal force vector to a maximum resultant centrifugal force vector; and means for measuring the current value of a controlled variable as the magnitude of the relative setting angle β is influenced directly or indirectly;

wherein:

measurable torque gradients of different signs are setable by the control means between the motors of the first group of part unbalance elements and the motors of the second group of part unbalance elements, the torques being measurable at the shafts of the motors, the torque gradient of the motors of one of the groups alternating from a positive value to a negative value, while passing through a range of adjustment from a smaller resultant static moment to a maximum resultant static moment, the motors being in a generate mode of operation when the torque gradient has a positive value, the values of the torque gradients on the motors of each group are equal in terms of direction and average magnitude, while maintaining the preferred direction of oscillation of the vibrator, and the predefinable value is set by influencing the values of the torque gradients on the motors, in terms of magnitude and direction, with the aid of the control means.

* * * * *